United States Patent [19]

Chenera

[11] Patent Number: 4,531,730

[45] Date of Patent: Jul. 30, 1985

[54] BODY STRETCHING AND EXERCISING DEVICE

[76] Inventor: Robert Chenera, 140 Walton Ave., Union, N.J. 07083

[21] Appl. No.: 476,766

[22] Filed: Mar. 18, 1983

[51] Int. Cl.[3] ..... A63B 23/04

[52] U.S. Cl. ..... 272/144; 272/126; 269/17; 128/25 R

[58] Field of Search ..... 272/144, 145, 131, 138, 272/69, 126, DIG. 10; 128/25 R, 70–74; 269/60, 61, 325, 326

[56] References Cited

U.S. PATENT DOCUMENTS

| | | | |
|---|---|---|---|
| 1,078,894 | 11/1913 | Ashby et al. | 128/73 |
| 2,152,431 | 3/1939 | Jensen | 128/74 |
| 2,240,228 | 4/1941 | Schall | 272/145 |
| 2,683,453 | 7/1954 | Tong | 269/326 |
| 2,783,045 | 2/1957 | Bosch | 272/144 |
| 3,006,643 | 10/1961 | Ryan | 272/144 |
| 3,008,643 | 10/1961 | Ryan | 272/144 |
| 3,489,142 | 1/1970 | Golay | 128/74 |
| 3,689,057 | 9/1972 | Webster | 269/60 |
| 3,887,180 | 6/1975 | Berman | 272/144 |
| 4,054,188 | 10/1977 | Pannell | 188/65.5 |
| 4,061,324 | 12/1977 | Kvaerng et al. | 269/325 |
| 4,344,616 | 8/1982 | Ogden | 272/69 |

*Primary Examiner*—Richard J. Apley
*Assistant Examiner*—S. R. Crow
*Attorney, Agent, or Firm*—Louis E. Marn

[57] ABSTRACT

There is disclosed a novel exercise assembly comprised of base support assembly on which is mounted a body support platform assembly including laterally extending platform members wherein the body support platform assembly may be readily vertically raised and lowered with respect to the base support assembly thereby changing the relative angle between the laterally extending platform members.

6 Claims, 7 Drawing Figures

BODY STRETCHING AND EXERCISING DEVICE

FIELD OF THE INVENTION

This invention relates to an exercise assembly, and more particularly to an exercising assembly for increasing leg and shoulder flexibility of the user.

BACKGROUND OF THE INVENTION

Exercise and the use of exerciser equipment and assemblies are of renew interest in improving physical fitness. Forms of body exerciser equipment are illustrated, inter alia, in U.S. Pat. Nos. 7,219,745; 1,539,214; 3,006,643 and 3,378,259, relating to stands and/or platform members.

Additionally, there is renewed interest in the marshal arts, e.g. karate, kung-fu, etc. Individual martial arts stress particular physical and mental requirements. In kung-fu, great emphasis in placed upon the use of leg kicks, and in particular, the cooperative flexability of an individuals legs to effect front leg kicks, side leg kicks, rear leg kicks, etc. Thus, greater effectiveness in the martial art of kung-fu is demonstrated by an individuals ability through flexibility to the legs at an angle approaching 180°. Additionally, there are other sports where improved leg and shoulder flexibility provide for greater agility, e.g, floor excercises, track and field events, etc.

OBJECTS OF THE INVENTION

An object of the present invention relates to a novel exercise assembly for improving an individual's legs flexibility.

Another object of the present invention relates to a novel exercise assembly readily adjustable for improving an individual's leg flexibility.

Still another object of the present invention relates to a novel exerciser assembly which is readily dis-assembled.

Yet another object of the present invention relates to a novel exercise assembly readily modified to permit use in exercises other than for improving leg flexibility.

A further object of the present invention relates to a novel exercise assembly permitting the concomitant use of weights.

SUMMARY OF THE INVENTION

These and other objects of the present invention are achieved by a novel exercise assembly comprised of base support assembly on which is mounted a body support platform assembly including laterally extending platform members wherein the body support platform assembly may be readily raised and lowered with respect to the base support assembly thereby changing the relative angle between the laterally extending platform members.

BRIEF DESCRIPTION OF THE DRAWINGS

A better understanding of the present invention as well as other objects and advantages thereof will become apparent upon consideration of the detailed disclosure thereof, especially when taken with the accompanying drawing, wherein.

DETAILED DESCRIPTION OF THE DRAWING

Figure 1:
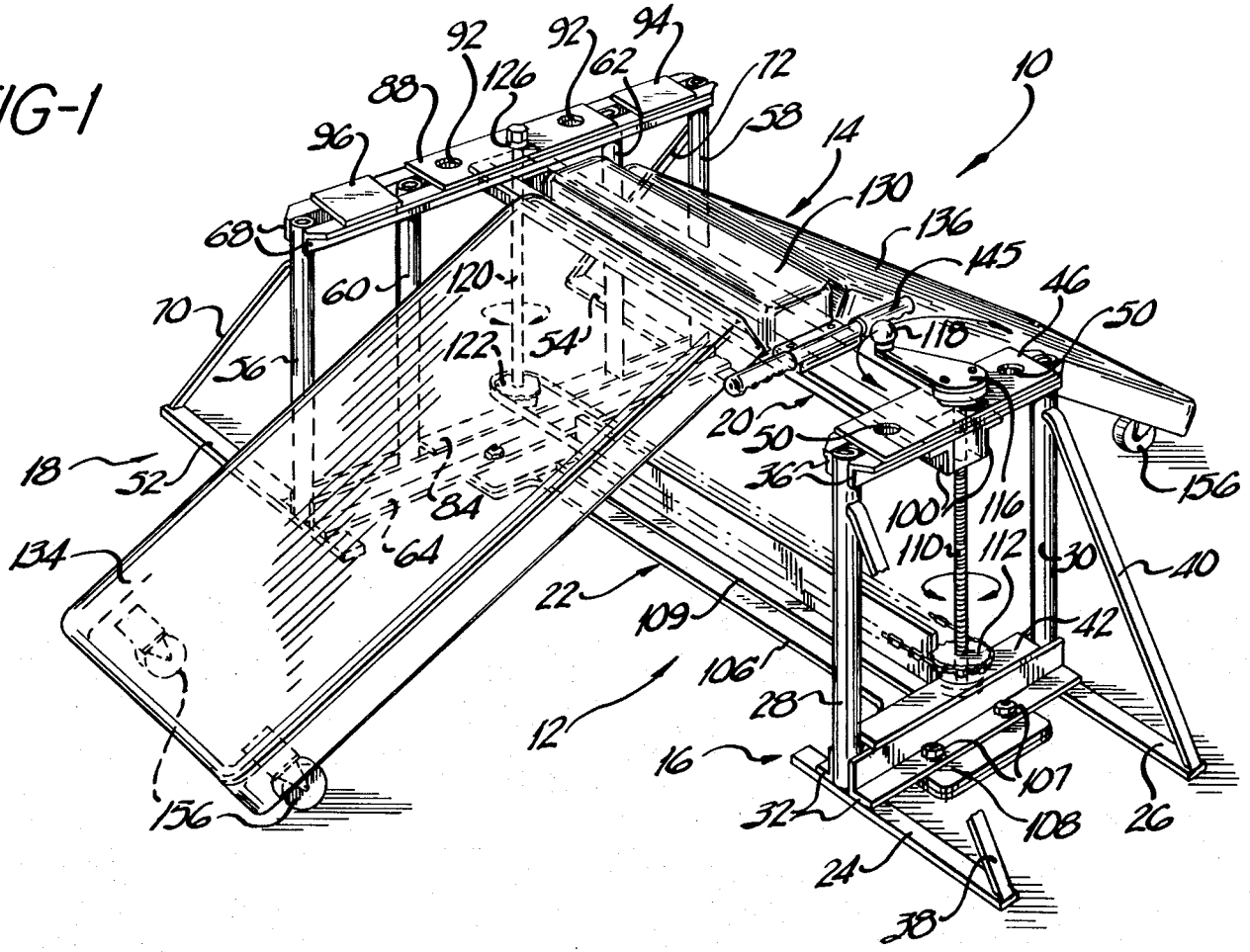
FIG. 1 is an isometric view, partially in phantom, of the novel exercise assembly of the present invention.

Referring now to the drawings, and particularly FIG. 1, there is illustrated an exercise assembly of the present invention, generally indicated as 10, comprised of a base support assembly and a body support platform assembly, generally indicated as 12 and 14, respectively, with the body support platform assembly 14 being transversely mounted with respect to the major axis of the base support assembly 12. The base support assembly 12 is comprised of a forward side frame member and a back side frame member, generally indicated as 16 and 18, respectively, spacially mounted in parallel relationship to another by upper and lower beam member, generally indicated as 20 and 22, respectively.

The forward side frame member 16 of the base support assembly 12 is comprised of horizontally and laterally-disposed flat bar elements 24 and 26 in spaced parallel relationship along the major axis of the base support assembly 12 for positioning on a foundation, such as a floor or stand attachment (not shown). To the flat bar elements 24 and 26, there are mounted vertically and parallelly-disposed tube elements 28 and 30, respectively, disposed in spaced parallel relationship by lower angle bar elements 32 including mounting orifices 34 and by upper angle bar elements 36.

Angularly-disposed from an upper portion of the tube elements 28 and 30 towards distal end portions of the flat bar elements 24 and 26, there are mounted support bars 38 and 40, respectively. To the upper edge portion of the lower angle bar elements 32, there is mounted a horizontally-disposed lower support plate member 42 including a centrally-disposed orifice 44. To the upper bar members 36, there is mounted an upper support plate member 46 including centrally-disposed orifice 48 and spaced apart orifice 50.

The rear side frame member 18 of the base support assembly 12 is comprised of horizontally-disposed flat bar elements 52 and 54 in spaced parallel relationship along the major axis of the base support assembly 12 also for positioning on a foundation, such as a floor or stand attachment (not shown). To the flat bar elements 52 and 54, there is mounted vertically and parallelly-disposed outer tube elements 56 and 58, respectively, and vertically and parallelly-disposed inner tube elements 60 and 62, respectively, mounted in spaced relationship by lower angle bar elements 64 including mounting orifices 66 and by upper angle bar elements 68.

Angularly-disposed from an upper portion of the tube elements 56 and 58 towards distal end portions of the flat bar elements 52 and 54, there are positioned support bars 70 and 72, respectively. To the upper edge portion of the lower angle bar elements 64, between inner tube elements 60 and 62, there is mounted a horizontally-disposed lower support plate member 84 including a centrally-disposed orifice 86. To the upper bar members 68 between inner tube elements 60 and 62, there is mounted an inner upper support plate member 88 including centrally-disposed orifice 90 and spaced apart orifices 92. Between outer and inner tube elements 56 and 60, and 58 and 62, then are mounted side support plates 94 and 96, respectively. The tube elements 56, 58, 60 and 62 are hollow to permit use of lifting apparatus in conjunction with the exercise assembly 10.

The upper beam member 20 is comprised of parallelly-disposed angle bar member 100 disposed in spaced relationship by inner mounting elements 102 including orifices 103 and outer mounting elements 104 including threaded orifices 105. The lower beam member 22 is comprised of a plate member 106 extending between and mounted, such as by nut and bolt assemblies 107, to the forward and back side frame members 16 and 18, respectively, together with space plates 108 welded to bars 32 and 64 thereby permitting the plate member 106 to likewise rest on the foundation when the assembly is not used with any stand attachments. Longitudinally-disposed on the plate member 106, there is mounted a an upright plate member 109, as more fully hereinafter discussed.

Vertically-disposed in the orifice 44 of the lower support plate member 42, threaded through the threaded orifice 105 of the outer mounting elements 104 and through the orifice 48 in the upper support plate member 46 of the forward side frame member 16, there is disposed an elongated threaded rod member 110 including a sprocket member 112 fixedly mounted proximate the lower support plate member 42 of the front side frame member 16. Over the upper end portion of the elongated threaded rod member 110 extending through the orifice 48 in upper support plate member 46, there is positioned a thrust bearing 114 with such upper end portion of the elongated threaded rod member 110 being mounted to a lever arm 116 including ball-shaped element 118 to effect rotation of the elongated rod member 110, more fully hereinafter discussed.

Vertically-disposed through the orifice 86 in the lower support plate member 84 threaded through the threaded orifices 105 of the outer mounting element 104 and though the orifice 90 in upper support plate member 88, there is provided an elongated threaded rod member 120 including a sprocket member 122 fixedly mounted proximate the lower support plate member 84. On an upper end portion of the elongated rod member 120 extending above the orifice 90 in upper support member 88, there is threadly mounted a nut 124 over a thrust bearing 126 for maintaining the vertical position of the elongated threaded rod member 120 within the back side frame member 18.

A chain 128 is coursed about the sprocket member 112 and 122 affixed to the elongated rod members 110 and 120, respectively, to permit cooperative rotation thereof for raising and lowering the upper mounting member 20, as more fully hereinafter described.

Figure 5:
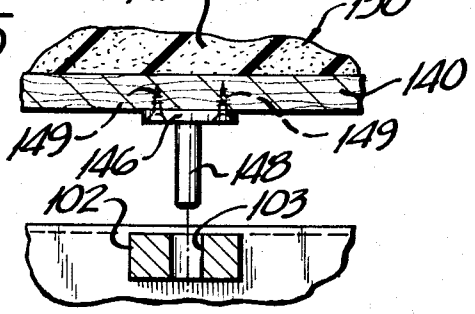
FIG. 5 is an enlarged partial cross-sectional view of the mounting arrangement.
Figure 4:
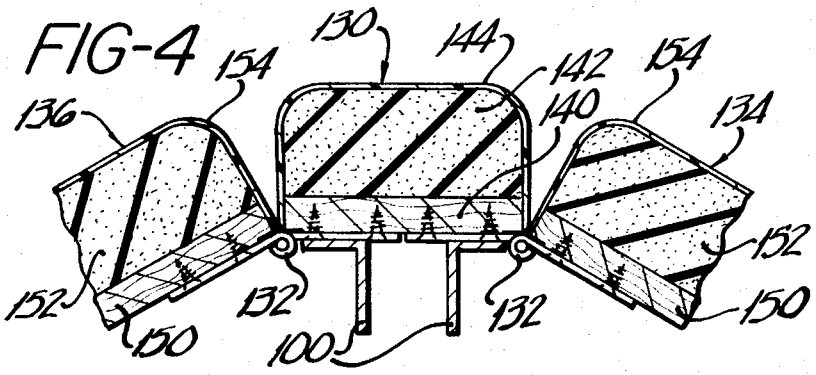
FIG. 4 is an enlarged partial cross-sectional view of the body support platform assembly.

The body support platform assembly 14 is comprised of a center support member 130 from which are hingeably mounted by hinge members 132 outwardly extending right and left side platform member 134 and 136, respectively, referring particularly to FIG. 4. The center support member 130 is formed of an elongated board 140 including a foam portion 142 overlayed by a vinyl covering 144. The center support member 130 includes a handle assembly 145 to assist the user in mounting and dismounting from the exercise assembly 10. An underside portion of the elongated board member 140, referring particularly to FIG. 5, is provided with centering members 146 including a pin element 148 mounted, such as by wood screws 149 to the elongated board 140. The pin elements 148 are positioned within the orifices 103 of the spacer elements 102 of the upper mounting member 20.

The side platform members 134 and 136 are formed of rectangularly-shaped panels 150 including a foam portion 152 overlayed by a vinyl covering 154. At a distal position on the underside portion of each panel 150 of the right and left side platform members 134 and 136, there are mounted roller members 156, as more fully hereinafter discussed. The underside portion of the side platform 150, referring particularly to FIG. 2 are provided with strengthening bar elements 158 including a plurality of notches 159 for receiving bar restraining members (not shown) for use in other exercise rountines, such as Roman sit-ups, etc.

Figure 6:
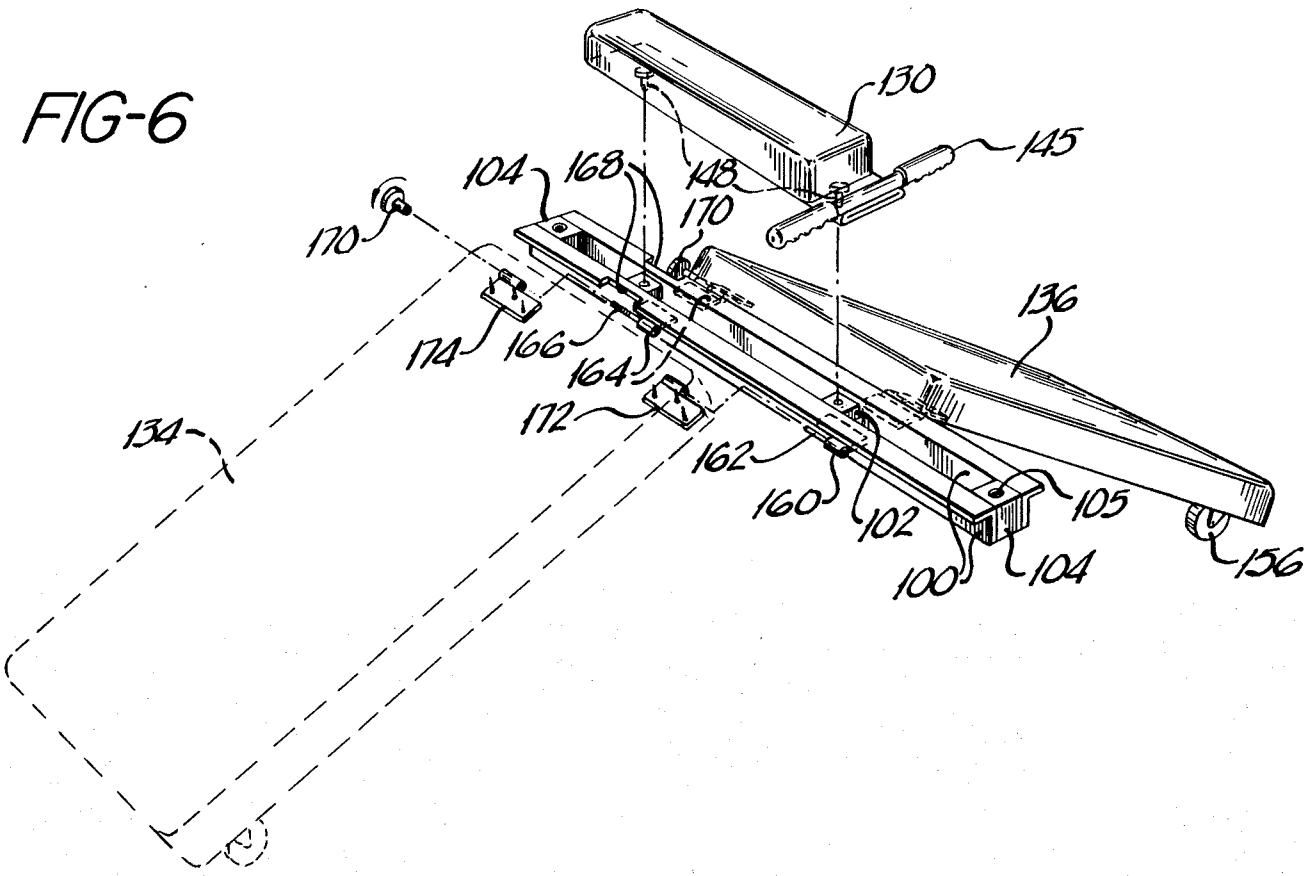
FIG. 6 is an exploded partial isometric view of another embodiment of the body support platform assembly of the present invention.

Referring now to FIG. 6, there is illustrated another embodiment for hingeably mounting the right and left side platform members 134 and 136, respectively, to the center support member 130. In accordance with such embodiment, to an underside portion of the angle bar members 100, there mounted, such as by welding, forward half hinge elements 160 including laterally extending pin 162 and rear half hinge elements 164 including laterally extending threaded pin 166. In the angle bar members 100 proximate the threaded pin 166, there is provided rectangularly-shaped open portion 168 to permit threading of a knurl nut 170 on the threaded pin 166 upon placement of the front and back half hinge elements 172 and 174 mounted to the platforms 150.

Figure 7:
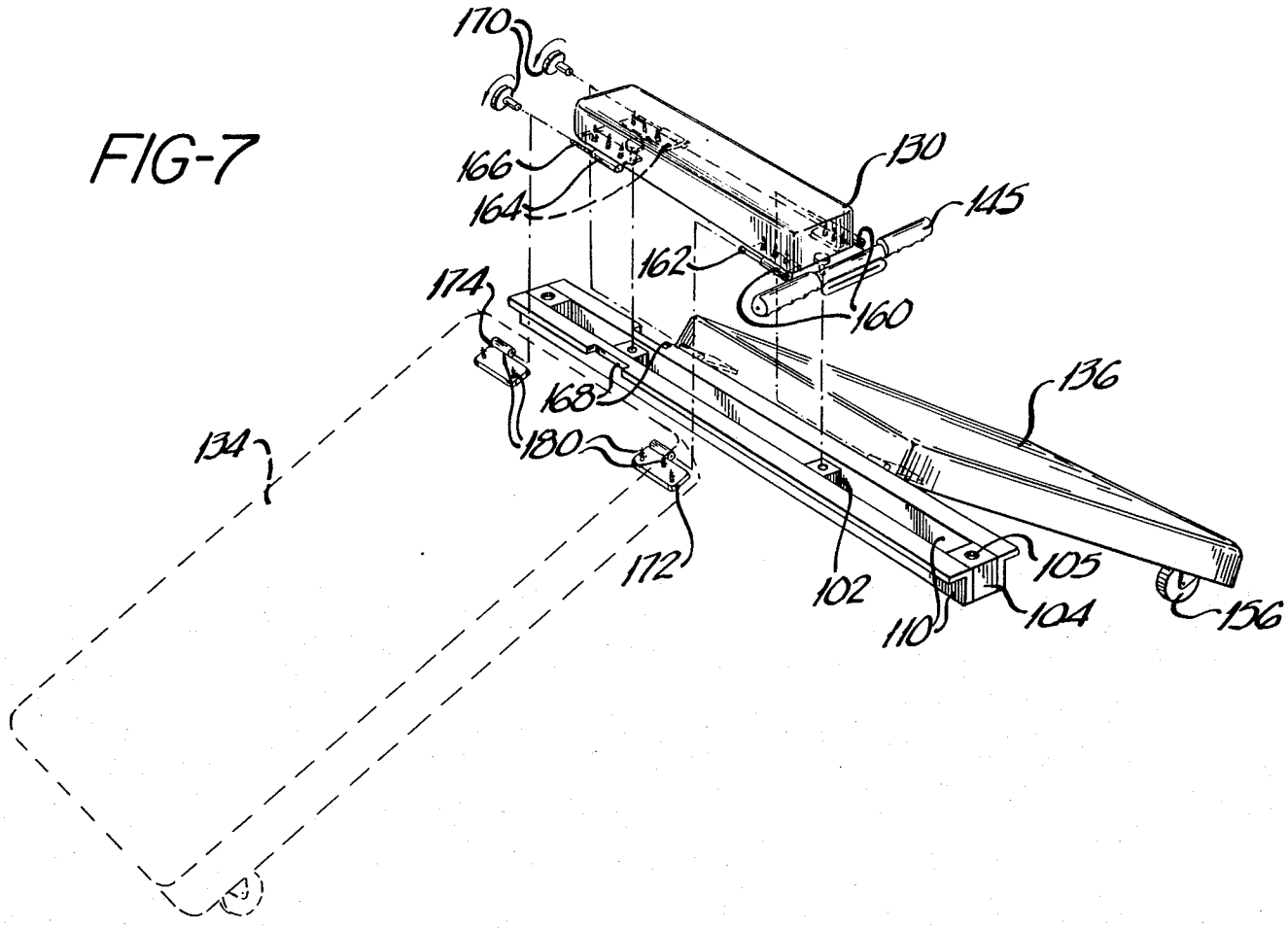
FIG. 7 is a partial exploded view of another hinging arrangement for the body support platform.

Referring now to FIG. 7, there is illustrated another hinging arrangement for mounting the right and left side platform member 134 and 136, respectively, to the center support member 130. Accordingly, to the underside portion of the board member 140, there are mounted, such as by wood screws 180, forwarded half hinge elements 160 including a laterally extending pin 162 and back half hinge elements 164 including a laterally extending threaded pin 166. In the angle bar member 100 proximate the threaded pins 166, there is provided rectangularly-shaped open portion 168 to permit threading of a knurl nut 170 on the threaded pin 166 upon placement of the front and back half hinge elements 172 and 174 mounted to the platform 150.

Figure 2:
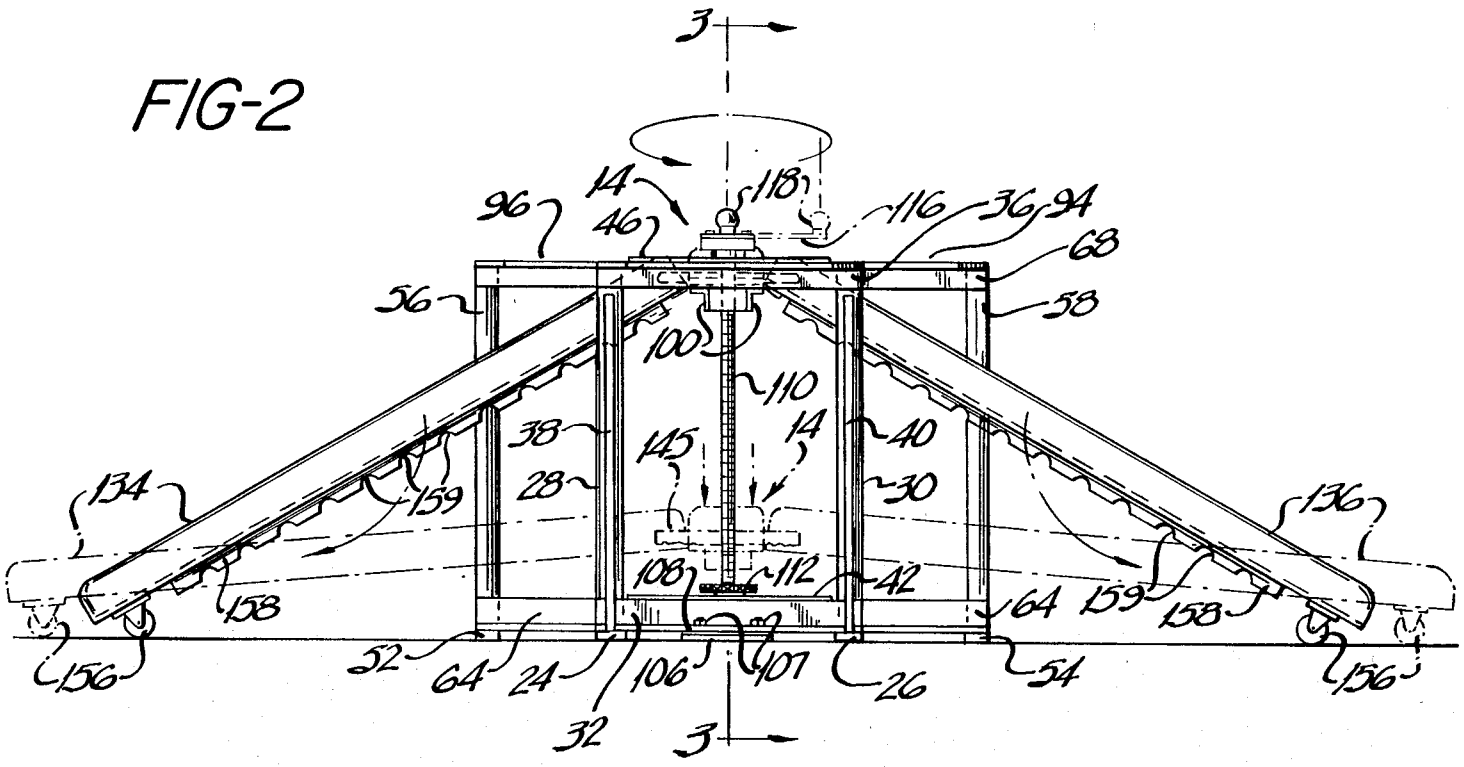
FIG. 2 is a front elevational view of the present invention.
Figure 3:
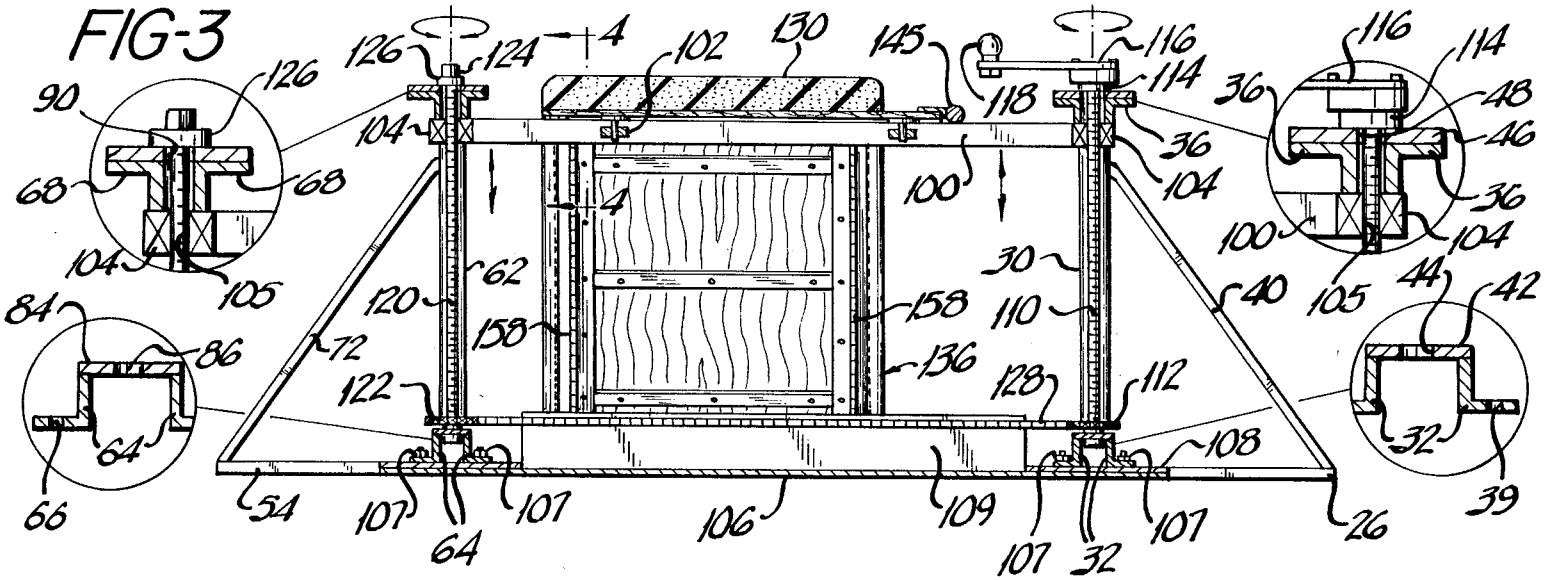
FIG. 3 is a cross-sectional view taken along the line 3—3 of FIG. 2.

In operation, a user interested in improving leg flexibility mounts the exercise assembly 10 together with the assistance of the handle 145, if necessary, to assume the position as illustrated in phantom in FIG. 2. Once straddling the exercise assembly 10, the user may readily lower the upper mounting member 20 aided by the rollers members 156, and thus increase the relative angle between the side platforms 134 and 136, by counterclockwise rotation of the handle 116 whereby each elongated rod member (via the sprockets and chain assembly), likewise rotate in a counterclockwise rotation to cause the threaded spacer elements 104 to be lowered onto the elongated threaded rod 110 and 120.

Conversely, by clockwise rotation of the handle 116, the upper mounting member 120 may be raised to decrease the relative angle between the side platforms 134 and 136.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed:

1. A novel exercise assembly upon which a human may assume a straddled position for improving leg flexibility, which comprises:

an elongated base support assembly;

a body support assembly including a center support member longitudinally disposed on said elongated base support assembly, and a first side platform having a first end portion thereof hinged to said center support member along a first longitudinal axis, said first side platform having a length sufficient to permit a second end portion of said first side platform to extend down and engage a foundation surface; and means for lowering and raising said body support assembly between a first vertical position and a second vertical position below said first vertical position, whereby upon lowering said body support assembly from said first vertical position to said second vertical position, said first longitudinal axis is lowered, said second end portion of said first platform moves transversely along said foundation surface, and said first side platform rotates about said lowered first longitudinal axis in an angular direction away from a vertical position, said means for lowering and raising said body support assembly being operable when a human has assumed a straddle position on said exercise assembly.

2. An exercise assembly as defined in claim 1 wherein said body support assembly includes a second side platform having one end portion thereof hinged to said center support member along a second longitudinal axis, said second side platform having a length sufficient to permit a second end portion of said second side platform to extend down and engage said foundation surface, whereby upon lowering said body support assembly from said first vertical position to said second vertical position, said second longitudinal axis is lowered, said second end portion of said second side platform moves transversely along said foundation surface, and said second side platform rotates about said lowered second longitudinal axis in an angular direction away from a vertical position, in a rotational direction opposite to the rotational movement of said first said platform.

3. The novel exercise assembly as defined in claim 1 wherein said base support assembly is comprised of a front side frame assembly and a back side frame assembly, and an upper mounting member disposed between said front and back side frame assemblies, and wherein said center support member is longitudinally disposed upon said upper mounting member.

4. The novel exercise assembly as defined in claim 3 wherein said means for lowering and raising said body support assembly includes vertically disposed elongated threaded rod members including sprocket members fixedly mounted on said front and rear side frame assemblies, a chain coursed between said sprocket members, one of said elongated threaded rod members being provided with a handle to rotate said one of said elongated rod members, and wherein said upper mounting member includes threaded elements for engaging said elongated threaded rod members, whereby rotation of said handle causes simultaneous rotation of said elongated threaded rod members to alter the relative vertical position of said upper mounting member and said central support member longitudinally positioned thereon.

5. The novel exercise assembly as defined in claim 1 wherein said first side platform is provided with roller means in the vicinity of said second end portion thereof, for riding on said foundation surface to facilitate transverse movement on said foundation surface as said body support assembly is lowered from said first vertical position to said second vertical position.

6. The novel exercise assembly in accordance with claim 2, wherein said first side platform is provided with first roller means in the vicinity of said second end portion thereof, and said second side platform is provided with second roller means in the vicinity of said second end portion thereof, said first and second roller means facilitating opposite direction, transverse movements of said first and second side platforms on said foundation surface as said body support assembly is lowered from said first vertical position to said second vertical position.

* * * * *

UNITED STATES PATENT AND TRADEMARK OFFICE

CERTIFICATE OF CORRECTION

PATENT NO. : 4,531,730

DATED : JULY 30, 1985

INVENTOR(S) : ROBERT CHENERA

It is certified that error appears in the above-identified patent and that said Letters Patent is hereby corrected as shown below:

Col. 1, line 25, after "to" should be -- dispose --.

Signed and Sealed this

*Twenty-second* Day of *October 1985*

[SEAL]

*Attest:*

DONALD J. QUIGG

*Attesting Officer*

*Commissioner of Patents and Trademarks—Designate*